US011221180B2

(12) United States Patent
Hawkins

(10) Patent No.: US 11,221,180 B2
(45) Date of Patent: Jan. 11, 2022

(54) SYSTEMS AND METHODS RELATED TO STAGED DRYING OF TEMPERATURE SENSITIVE MATERIALS

(71) Applicant: Innovative Environmental Companies, Inc., Rockford, IL (US)

(72) Inventor: Walter J. Hawkins, Delafield, WI (US)

(73) Assignee: Innovative Environmental Companies, Inc., Rockford, IL (US)

( * ) Notice: Subject to any disclaimer, the term of this patent is extended or adjusted under 35 U.S.C. 154(b) by 54 days.

(21) Appl. No.: 16/838,111

(22) Filed: Apr. 2, 2020

(65) Prior Publication Data

US 2020/0318904 A1 Oct. 8, 2020

Related U.S. Application Data

(60) Provisional application No. 62/919,872, filed on Apr. 2, 2019.

(51) Int. Cl.

| | |
|---|---|
| ***F26B 17/00*** | (2006.01) |
| ***F26B 3/04*** | (2006.01) |
| ***F26B 7/00*** | (2006.01) |
| ***F26B 21/04*** | (2006.01) |
| ***F26B 15/20*** | (2006.01) |

(52) U.S. Cl.

CPC ..... *F26B 17/00* (2013.01); *F26B 3/04* (2013.01); *F26B 7/007* (2013.01); *F26B 21/04* (2013.01); *F26B 15/20* (2013.01)

(58) Field of Classification Search

CPC .. F26B 17/00; F26B 3/04; F26B 7/007; F26B 21/04; F26B 15/20

USPC ..... 34/443

See application file for complete search history.

(56) References Cited

U.S. PATENT DOCUMENTS 3,212,197 A * 10/1965 Crawford ..... F26B 3/08 34/371
4,213,888 A * 7/1980 Karg ..... C08C 3/00 524/553
4,304,049 A * 12/1981 Curtius ..... C05F 7/00 34/361

(Continued)

OTHER PUBLICATIONS

Carrier Vibrating Equipment, Inc., Fluid-Flow Vibrating Fluid Bed Systems, 1992, 12 Pages, Carrier Vibrating Equipment, Inc., Louisville, United States.

(Continued)

*Primary Examiner* — Stephen M Gravini
(74) *Attorney, Agent, or Firm* — Smith Keane LLP

(57) ABSTRACT

A system and method for staged drying of temperature sensitive materials, the method comprising the following steps. Heated air is blown into a duct and solids are introduced into the duct at an elevated position along a vertical portion of the duct. The heated air and solids mixture is then transported along the duct for a desired retention time with adequate initial flash heating of the solids and then a gradual cool down of the solids. The solids are at an elevated temperature beyond the ambient dewpoint with evaporative cooling taking place. The solids and air mixture is then transported in the duct to a cyclone, where the solids are removed from the air. The air is exhausted out of the cyclone by an exhaust duct, and the solids are collected from the cyclone in a container.

2 Claims, 7 Drawing Sheets

(56) References Cited

U.S. PATENT DOCUMENTS

| | | | | |
|---|---|---|---|---|
| 4,395,830 | A * | 8/1983 | Lockwood | F26B 3/082 34/191 |
| 4,436,589 | A * | 3/1984 | Petrovic | C10B 57/10 201/41 |
| 6,085,440 | A * | 7/2000 | Getler | F26B 3/0923 34/135 |
| 7,322,124 | B2 * | 1/2008 | Bouman | B01D 1/18 34/138 |
| 7,343,699 | B2 * | 3/2008 | Svonja | F26B 21/00 34/467 |
| 7,651,565 | B2 * | 1/2010 | Falinower | F27D 3/08 106/772 |
| 8,188,163 | B2 * | 5/2012 | Matsumoto | C08J 3/12 523/330 |
| 9,506,691 | B2 * | 11/2016 | Orr | F26B 21/14 |
| 10,159,908 | B2 | 12/2018 | Thomas | |
| 10,456,708 | B2 | 10/2019 | Thomas | |
| 10,555,914 | B1 | 2/2020 | Metcalf | |
| 10,609,944 | B1 | 4/2020 | Metcalf | |
| 10,610,805 | B1 | 4/2020 | Metcalf | |
| 10,617,974 | B2 | 4/2020 | Thomas | |
| 10,745,517 | B2 * | 8/2020 | Christel | B29B 9/065 |
| 10,914,519 | B2 * | 2/2021 | Krohl | F26B 21/08 |
| 2006/0210687 | A1 | 9/2006 | Lundberg et al. | |
| 2010/0083525 | A1 * | 4/2010 | Lange | A23N 12/10 34/443 |
| 2010/0146814 | A1 | 6/2010 | Baker et al. | |
| 2010/0249320 | A1 * | 9/2010 | Matsumoto | C08F 6/008 524/832 |
| 2017/0067686 | A1 | 3/2017 | Baker et al. | |
| 2017/0127716 | A1 | 5/2017 | Lundberg | |
| 2018/0078874 | A1 | 3/2018 | Thomas | |
| 2019/0151771 | A1 | 5/2019 | Thomas | |
| 2020/0011600 | A1 * | 1/2020 | Hensel | F26B 11/028 |
| 2020/0048214 | A1 | 2/2020 | Thomas et al. | |
| 2020/0048215 | A1 | 2/2020 | Thomas et al. | |
| 2020/0080021 | A1 | 3/2020 | Thomas | |
| 2020/0129882 | A1 | 4/2020 | Thomas | |
| 2020/0182544 | A1 * | 6/2020 | Caspers | F26B 23/10 |
| 2020/0318904 | A1 * | 10/2020 | Hawkins | F26B 17/107 |

OTHER PUBLICATIONS

Carrier Vibrating Equipment, Inc., Tornesh and Flash Dryers, 2001, 6 Pages, Carrier Vibrating Equipment, Inc., Louisville, United States.

* cited by examiner

SYSTEMS AND METHODS RELATED TO STAGED DRYING OF TEMPERATURE SENSITIVE MATERIALS

PRIOR RELATED APPLICATION

This application claims the benefit of U.S. Provisional Patent Application Ser. No. 62/919,872 filed 2 Apr. 2019 and titled "Effects of Staged Drying for Temperature Sensitive Materials," which is incorporated herein by reference in its entirety.

BACKGROUND

This disclosure relates generally to a system and method for transporting and drying a moisture laden bulk material and, more particularly, to a staged drying process for temperature sensitive materials, such as certain plants or portions thereof.

The proposition of thermally treating discrete bulk solids that are highly temperature sensitive in chemical composition during the heating process has troubled engineers and plant operators for many years. Perhaps the best-known example is that of materials that undergo a chemical decomposition in thermal processing upon heating. There is especially a need for a better system and method to address the needs of the botanical extract, essential oil or pharmaceutical components from bio mass markets.

The fastest growing segment of the industrial drying technologies is the use of fast or flash drying. Flash dryers prove to be highly efficient and easy to use but have an inherent weakness if the feed to be processed has a wide variation in feed stock particle size distribution or moisture. Flash dryers can prove to be poor in terms of quality control for end product quality. The coarse end of incoming feed will likely fall out of suspension whereas the finest portion may be elutriated too easily and hence not have enough dwell time for full thermal treatment. There is a need to address these weaknesses in conventional flash dryer systems.

The concept of solids suspension in gas is fairly well studied but complex, nonetheless. Factors such as particle density, particle shape, particle size, gas fluid density, and gas velocity all affect the dynamics in such a two-phase system. In addition to these factors, industrial dryers, reactors and calciners may not always be in steady state with temperatures, material feed stocks and flow dynamic regimes (laminar or turbulent) changing in time. A design is needed to address these very complex issues in a simple and easily operated machine.

SUMMARY

The disclosed method combines process steps to address these issues. In a first stage a high sheer mill preferably grinds and/or conditions material to a fairly uniform particle size through an integral screen.

The next process step is to introduce the conditioned material or solids into a hot gas (e.g., about 700 to about 800 degrees Fahrenheit), such as hot air, available from a pre-dryer heater. The pre-dryer is capable of operating with higher inlet gas temperatures compared to rotary or fluid bed dryers due to the true plug flow nature of the design. A plug flow dryer is a model used to describe chemical reactions in a continuous, flowing system of cylindrical geometry.

Due to the unique operation of this system, the ability exists to classify product based on particle size and/or density (e.g., moisture content), such as through elutriation. A focused application of high pressure and/or velocity drying fluid (e.g., air) near the gravitational bottom of a cyclone effectively contemporaneously dries wetter particles (e.g. more dense, and located near bottom of cyclone) and drier particles (e.g., less dense, located above wetter particles) to allow for efficient elutriation or further processing.

The pre-dryer is combined with a secondary polish dryer, most typically a fluid bed dryer. The disclosed dryer system combines a fluid bed drying section for efficient drying utilizing lower product temperatures to attempt to lessen product degradation.

A two-staged drying process according to the present invention includes the steps of passing material through a flash dryer (i.e., a pneumatic-conveying dryer), conveying the material to a fluid bed, and removing moisture from the material with the fluid bed. A majority of the material is preferably exposed to a maximum flash dryer temperature for a first dry time (e.g., preferably two seconds or less, and more preferably about 0.5 to about 1.0 second) and is conveyed to and supported in the fluid bed for a second dry time (e.g., about two to about five minutes). The second dry time is preferably greater than the first dry time, and more preferably the second dry time is thirty to six hundred times the first dry time. A preferred flash dryer uses conveying air velocity that is greater than an ambient terminal velocity of a solid particle of a predetermined material and predetermined maximum size, thereby ensuring a material particle velocity that is greater than zero in the same direction as the conveying air. Conveyance of the material particles after being heated by the flash dryer (pre-dryer) along a pre-dryer duct occurs for a predetermined retention time that is sufficient to allow for partial evaporation heat absorption from the gas. The particles are conveyed to a dilute phase fluid bed dryer wherein the material stays in a much cooler environment (e.g., about 200 to about 300 degrees Fahrenheit, with about 250 degrees being more preferred) for up to 5 minutes to continue the drying process. Temperature and gas environments may be preset and/or dynamically adjusted so as to establish low dewpoint temperatures of the gases for lower product (material) temperature, in coordinated effort to increase or maximize gas to solids contact time and efficacy. Inherent in this design, the larger particles that by nature need more time for drying than the smaller particles.

DETAILED DESCRIPTION

Although the disclosure hereof enables those skilled in the art to practice the invention, the embodiments described merely exemplify the invention which may be embodied in other ways. While the preferred embodiment has been described, the details may be changed without departing from the invention, which is defined by the claims. It should be noted that like part numbers represent like parts among the various embodiments.

Figure 1:
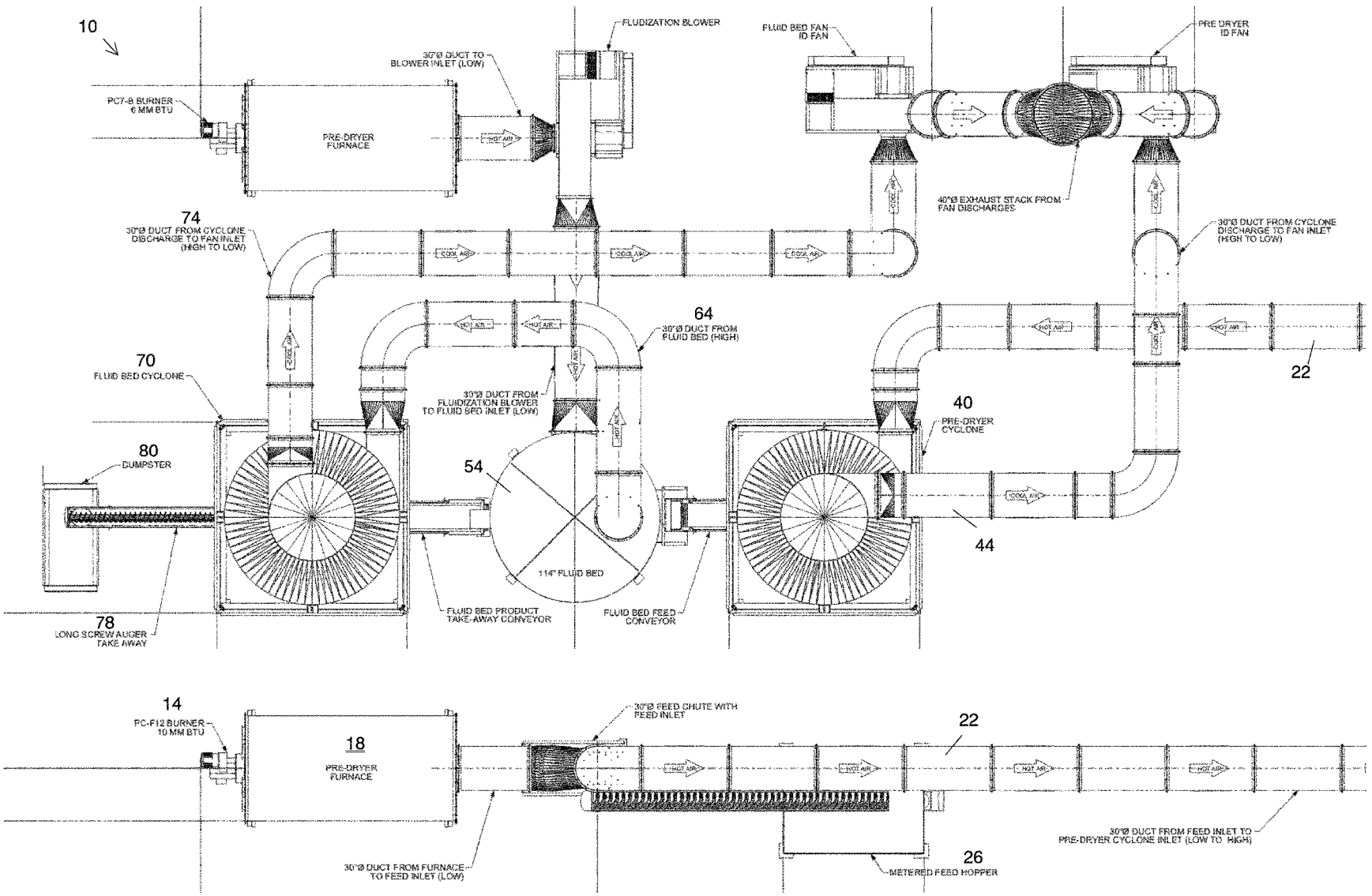
FIG. 1 is a top view of a system according to this disclosure.
Figure 2:
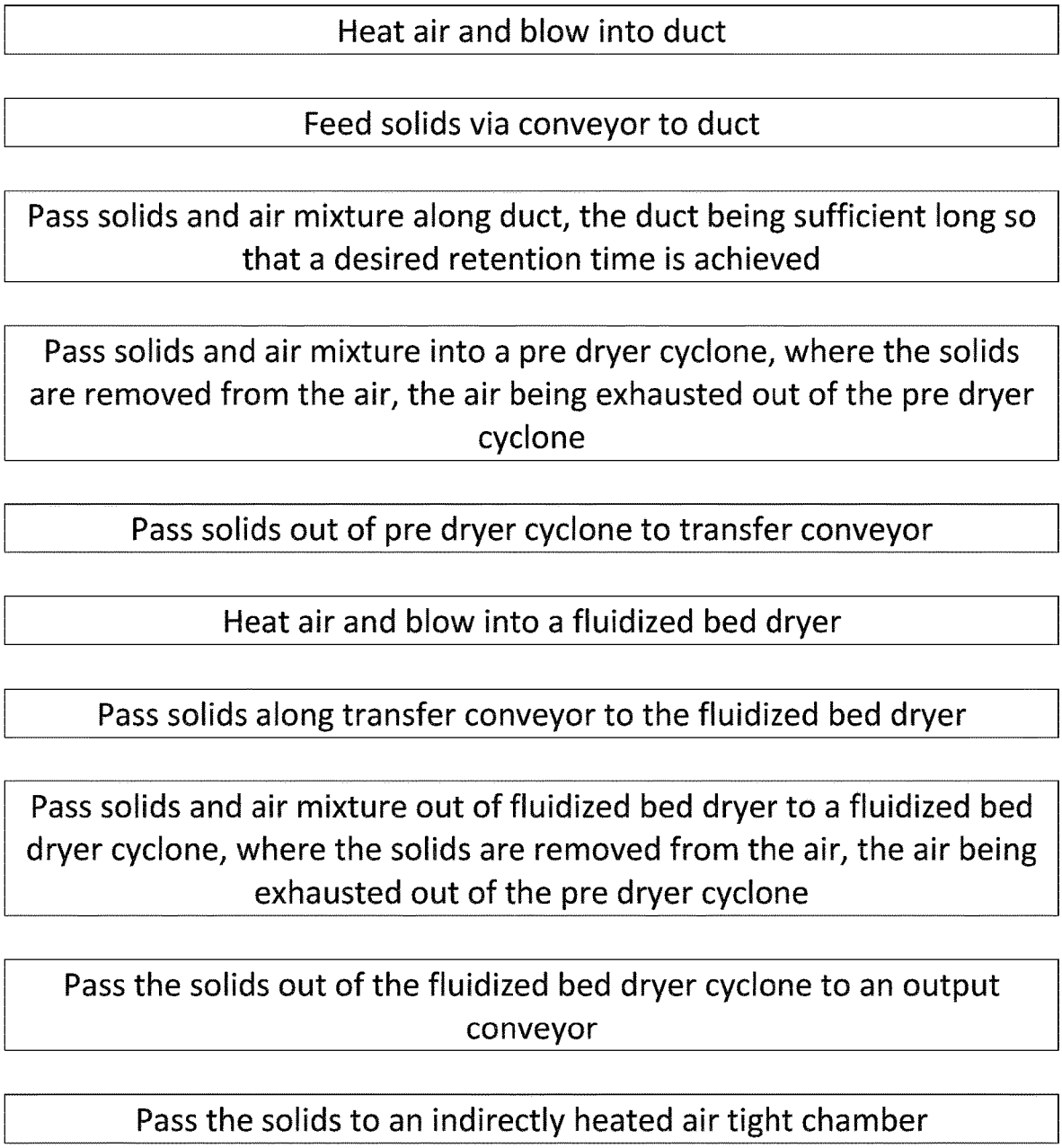
FIG. 2 is a flow diagram illustrating a method according to this disclosure.
Figure 3:
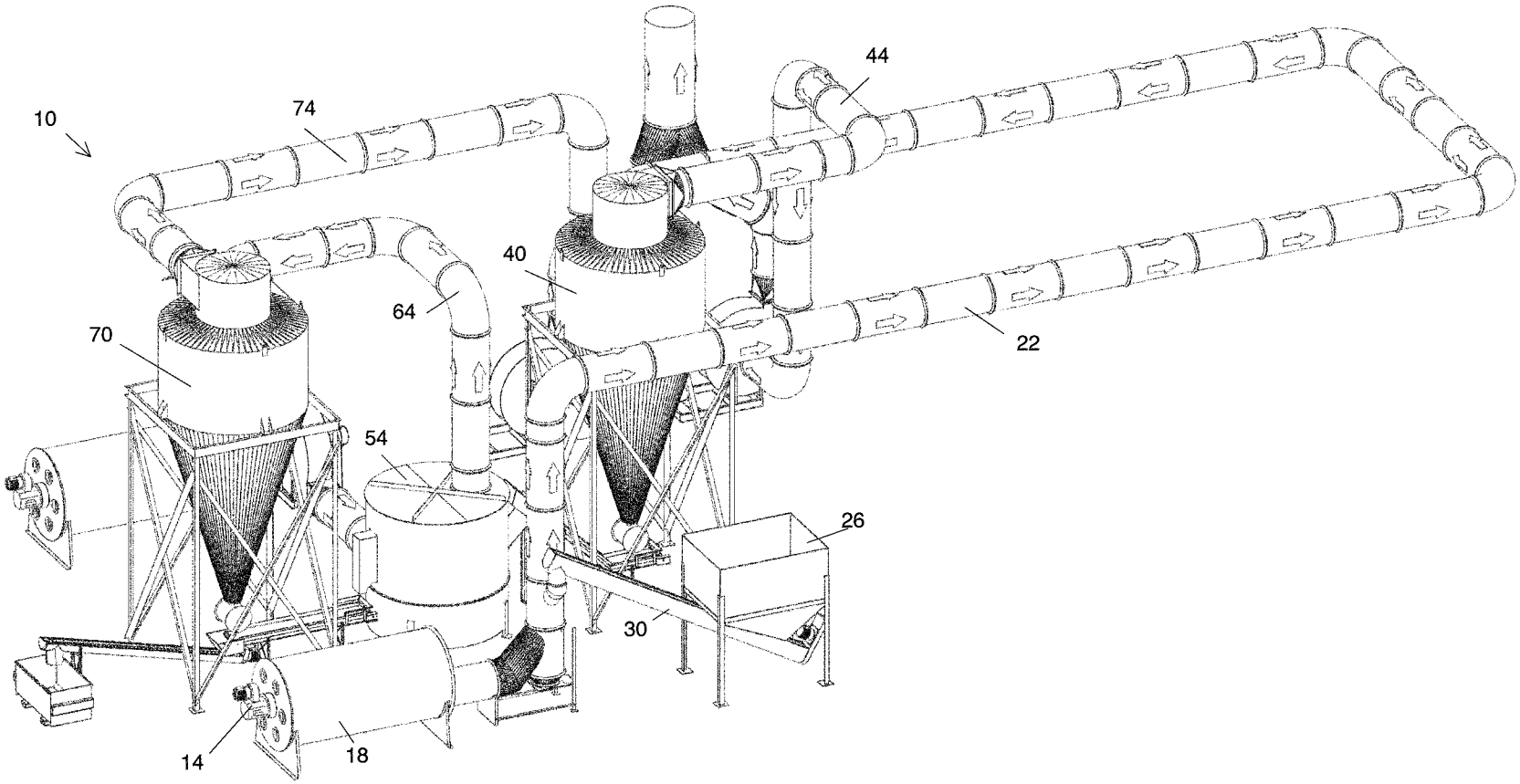
FIG. 3 is a front side view of the system shown in FIG. 1.

FIGS. 1 through 7 illustrate an embodiment of a system 10 and method for staged drying for temperature sensitive materials according to this disclosure. As illustrated in FIG. 3, air is heated by a burner 14 and furnace 18 and is induced into a pre-dryer duct 22. Blowers 20 (see FIG. 4) are used throughout the system to provide induced air. The material or solids to be heated are feed into a metered feed hopper 26. In one embodiment, the material is hemp including stems and pieces. Preferably, the solids are ground and sized in a mill (not shown) before being placed into the metered feed hopper 26. The mill grinds and conditions the material to a fairly uniform particle size through an integral screen (not shown). In other embodiments (not shown), the solids might be ground in or as it leaves the hopper.

Figure 6:
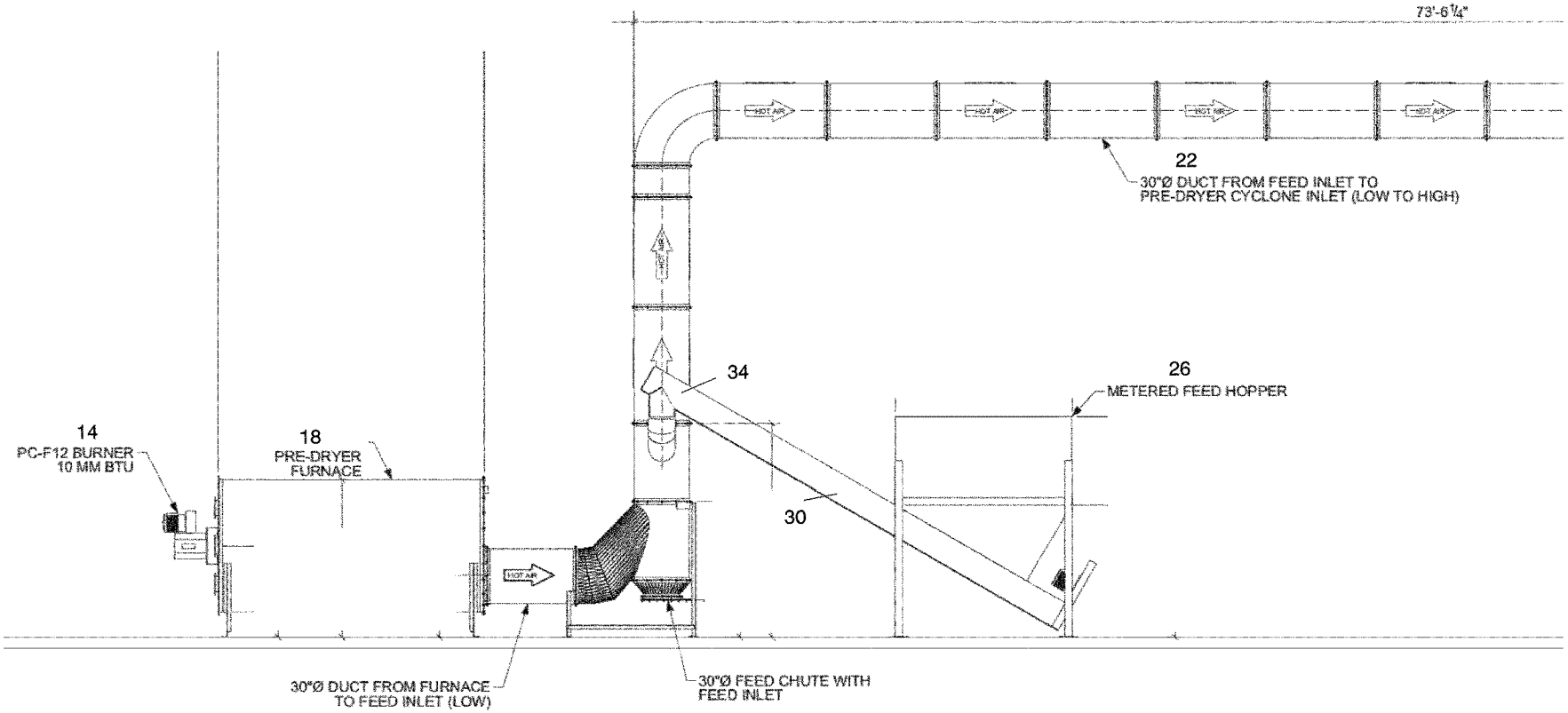
FIG. 6 is a partially broken away front portion of a front side view of the system shown in FIG. 1.

As illustrated in FIG. 6, the solids are then transported by a conveyor 30 to an elevated position along a vertical portion of the pre-dryer duct 22. The solids enter the pre-dryer duct at a duct feed entrance 34 at the elevated position. As the solids enter the pre-dryer duct 22, the solids get entrapped in the hot air and transported along the pre-dryer duct 22. In the illustrated embodiment, the pre-dryer duct 22 is about 150 feet long, although other lengths and diameters of the duct can be used. This length of the pre-dryer duct 22 allows for a desired retention time with adequate initial flash heating of the solids and then a gradual cool down of the solids. The solids cool in the transfer stage from pre-dryer as the solids are at an elevated temperature beyond the ambient dewpoint and evaporative cooling takes place.

The disclosed drying system 10 especially benefits the drying of biomass in that it operates as a true plug flow reactor wherein the coldest wettest product is exposed to the hottest drying gases. As the product dries and is more at risk of combustion, the gases have become progressively colder. This approach can be beneficially used in any temperature sensitive elevated temperature processing including those where recovery of solvent from post extraction biomass is desired.

As illustrated in FIG. 3, the solids and air mixture is then led by the pre-dryer duct 22 into a pre-dryer cyclone 40, where the solids are removed from the air, and the air is exhausted out of the pre dryer cyclone 40 by an exhaust duct 44. The basic premise of the cyclone 40 is to separate the solids from the gas by cyclonic forces.

Figure 4:
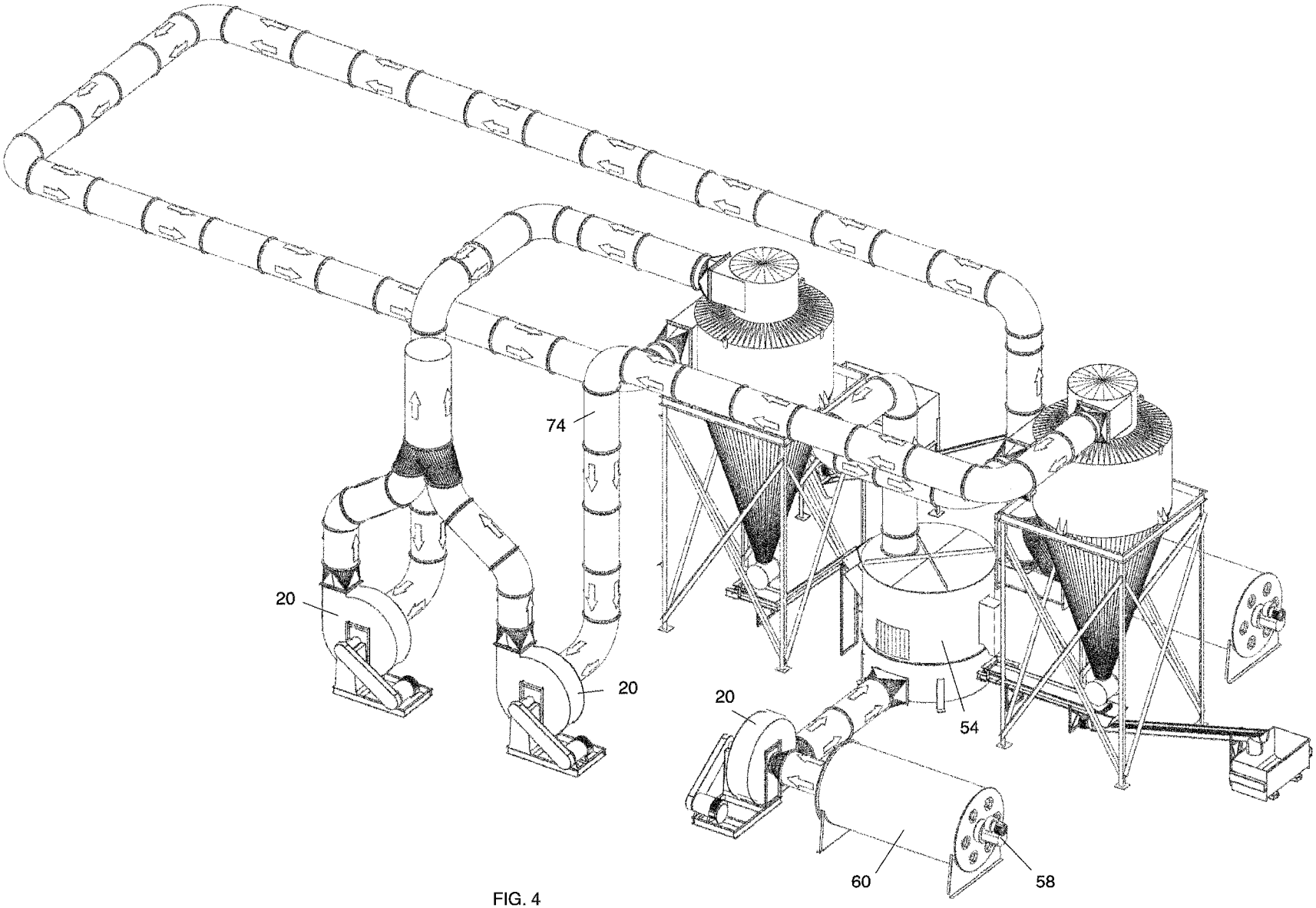
FIG. 4 is a rear side view of the system shown in FIG. 1.
Figure 5:
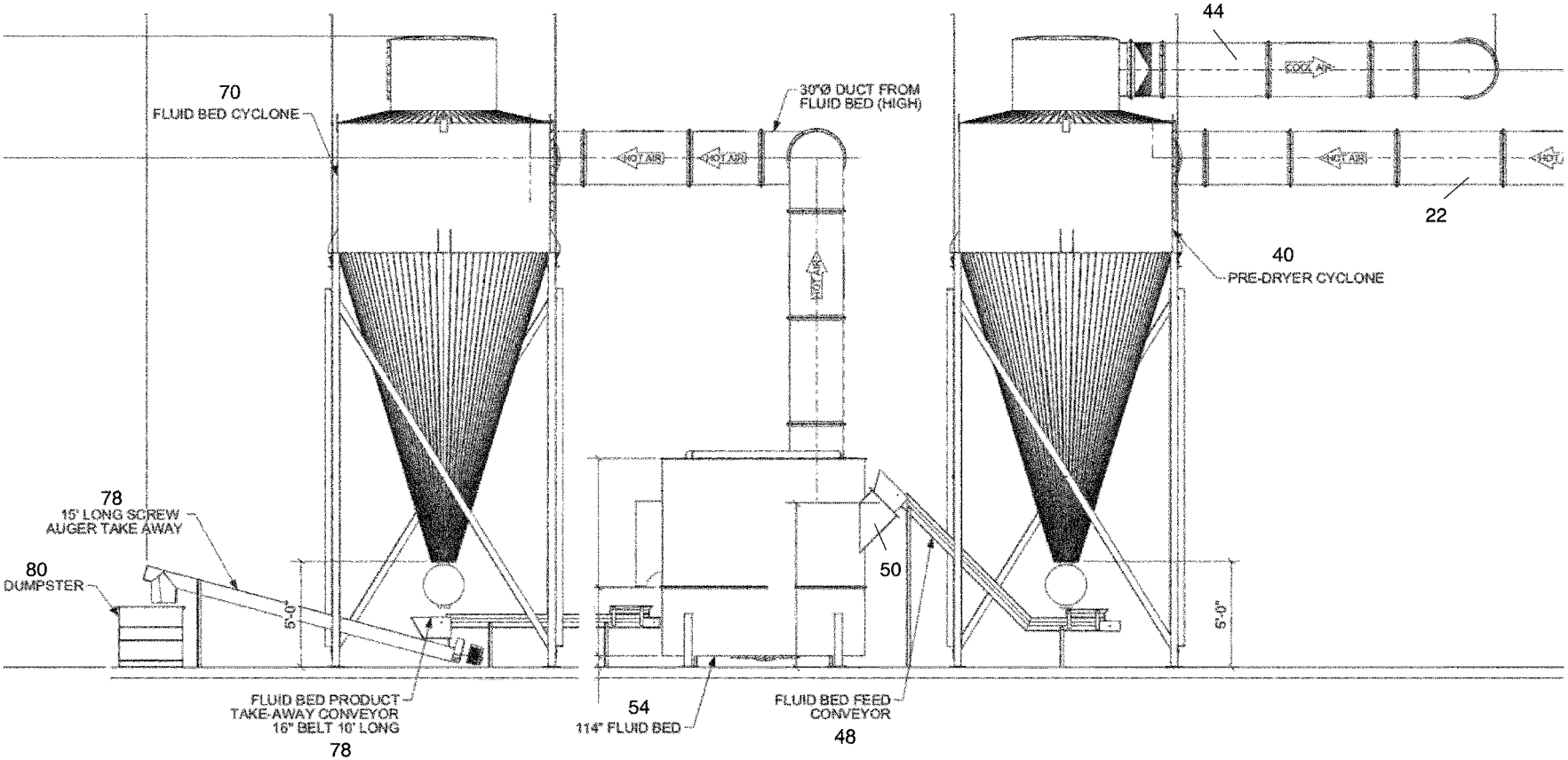
FIG. 5 is a partially broken away rear portion of a front side view of the system shown in FIG. 1.

As shown in FIG. 5, the solids then leave the pre-dryer cyclone 40 and drop to a transfer or fluidized bed conveyor 48. The transfer conveyor 48 transports the solids to a fluidized feed entrance 50 at an elevated position in a fluidized bed dryer 54. As shown in FIG. 4, a bed burner 58 and bed furnace 60 supply heated air to the base of the fluidized bed dryer 54. As the solids enter the fluidized bed dryer 54, the solids are again mixed with heated air. As shown in FIG. 3, after being heated in the fluidized bed dryer 54, the hot air and solids mixture is then transported out of the fluidized bed dryer 54 by a fluidized bed dryer duct 64 to a fluidized bed dryer cyclone 70, where the solids are removed from the air, the air being exhausted by an exhaust duct 74 out of the fluidized bed dryer cyclone 70. A fluid bed product take-away conveyor may also be utilized to receive a deposit of smaller particles that quickly leave the fluid bed as suspended solids and larger particles which need more time for drying stay in the fluid bed vessel for longer times until ultimately become dry enough to become suspended or elutriated or simply displaced by incoming material from the pre-dryer cyclone. It is to be understood that the function of each of the pre-dryer cyclone 40 and the fluidized bed dryer cyclone 70 may be swapped, with operative alterations to duct work. Swapping cyclone positions/functionality may assist to effectively shrink the overall footprint or length of the entire system 10 by maintaining a desired length of the pre-dryer duct 22, but shifting the pre-dryer cyclone functionality to a side of the fluidized bed dryer 54 opposite the majority of the length of the pre-dryer duct 22.

Figure 7:
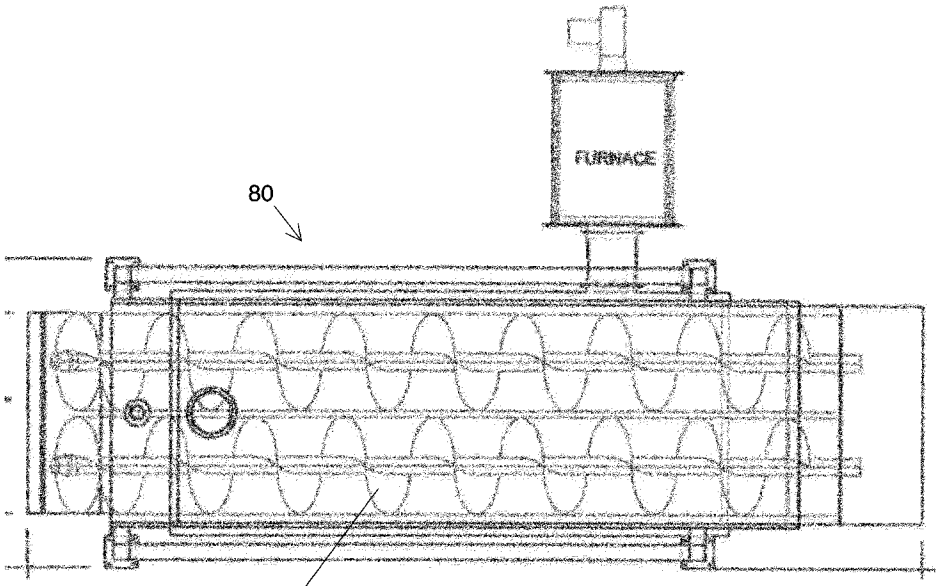
FIG. 7 is a cross sectional top view of an indirectly heated retention vessel.

As shown in FIG. 5, the solids then are dropped out of the fluidized bed dryer cyclone 70 onto an output screw auger 78, where the solids are then transferred to a container 80. In one embodiment, the container 80 is an indirectly heated air tight chamber or autoclave, as shown in FIG. 7, where a screw 84 is rotated to keep all of the material exposed to heat.

The disclosed staged drying results in the lowest possible temperatures. Staged drying allows aggressive treatment of the highly wet initial stages coupled with more gentle temperature regimes on the partially dried feed. Products especially appropriate for this system and method of staged drying for temperature sensitive materials include, but are not limited to wood products, agricultural products and bi-products, and cannabinoids, such as hemp. A secondary benefit to this staged drying is there is some demonstrable degree of evaporative cooling while being conveyed between stages.

The disclosed orientation of gas and solids flow within the disclosed two-stage dryer is unique to other industrial drying techniques and may be important to successful operation. The mass of gas and gas temperature is determined by the thermal load of a given process. The overall dryer volume and geometry is determined by exact process requirements such as retention time considerations.

In other embodiments (not shown), several options exist for the removal of the solids from the fluid bed dryer. Material and gas can exit by positive pressure head or can be induced by imposing a modest draft in the upper section of the fluid bed dryer.

In another embodiment (not shown) of the disclosed system and method, only the one pre-drying step can be used. In cases, however, of high moisture removal loads, mass transfer will lag heat transfer and the flash drying approach will be insufficient. In such cases, the fluid bed dryer is used to increase drying time. The initial flash stage is truly plug flow where the hottest gases (e.g., about 700 to about 800 degrees Fahrenheit) are in direct contact with only the coldest wettest solids. The fluid bed stage is a continuously stirred vessel type design meaning that some dried product is exposed to fully hot gases (e.g., about 200 to 300 degrees Fahrenheit, with about 250 degrees being most preferred). As such, in fluid bed processing only, inlet temperatures have to be greatly reduced thereby decreasing efficiency. The concept of coupling a plug flow flash dryer to a fluid bed offers the best possible thermal efficiency.

Further, in cases where thermal treatment of products is needed to reduce biological activity, such as killing pathogens, the disclosed method couples the attrition flash dryer system to an indirectly heated retention vessel such as depicted in FIG. 7. This vessel can be a rotating drum or a screw conveyor vessel. The material is heated and dried in the drying stage to the desired end product, and then the material is introduced into a sealed vessel that acts as an autoclave. There is no airflow or resulting drying, but the material temperature is elevated to approximately 160 F for effective pathogen kill.

Further, in some cases, the use of the disclosed indirectly heated vessel can be used if a specific atmospheric composition or gas is needed to carry out a desired reaction with the material.

In another embodiment an internal rake arm (not shown) is added to the fluid bed to redirect untreated particles back into the most aggressive reaction zones.

In another embodiment (not shown), the exhaust from one stage can be coupled or recycled to another stage for reasons of efficiency or reduction in overall gas volume for emissions compliance reasons.

In another embodiment, the fluid bed drying column can include internal adjustable weirs (not shown) so as to control retention time of courser product needing more retention time for full drying.

The foregoing is illustrative only of the principles of embodiments according to the present invention. Modifications and changes will readily occur to those skilled in the art, so it is not desired to limit the invention to the exact disclosure herein provided. While the preferred embodiment has been described, the details may be changed without departing from the invention, which is defined by the claims.

The invention claimed is:

1. A method for staged drying of temperature sensitive materials, the method comprising the steps of:

blowing heated air into a duct;

introducing solids into the duct at an elevated position along a vertical portion of the duct;

transporting the heated air and solids mixture along the duct for a desired retention time with adequate initial flash heating of the solids by the heated air, the retention time causing a gradual cool down of the solids, the solids being at a temperature above the ambient dew-point causing evaporative cooling to take place.

2. A method according to claim 1, further comprising the steps of:

transporting the solids and air mixture in the duct sequentially to at least one of a first cyclone separator, a fluidized bed dryer, and a second cyclone separator; and collecting the solids in a container.

* * * * *